US011882916B2

(12) United States Patent
Dunton et al.

(10) Patent No.: US 11,882,916 B2
(45) Date of Patent: Jan. 30, 2024

(54) REFILLABLE COSMETIC DISPENSER

(71) Applicant: HCP Packaging USA, Inc., Shelton, CT (US)

(72) Inventors: David P. Dunton, Stratford, CT (US); Stephen G. Dudienski, Ansonia, CT (US)

(73) Assignee: HCP Packaging USA, Inc., Shelton, CT (US)

( * ) Notice: Subject to any disclaimer, the term of this patent is extended or adjusted under 35 U.S.C. 154(b) by 758 days.

(21) Appl. No.: 17/031,169

(22) Filed: Sep. 24, 2020

(65) Prior Publication Data

US 2022/0087399 A1 Mar. 24, 2022

(51) Int. Cl.
*A45D 40/06* (2006.01)
*A45D 40/00* (2006.01)

(52) U.S. Cl.
CPC ..... *A45D 40/06* (2013.01); *A45D 2040/0031* (2013.01); *A45D 2040/0056* (2013.01)

(58) Field of Classification Search
CPC ..... A45D 40/06; A45D 2040/0056; A45D 40/00; A45D 2040/0025; A45D 2040/0031; A45D 2040/0043; A45D 2040/005; A45D 40/02; A45D 40/04; A45D 2040/208; B65D 83/0005; B65D 83/0011
USPC ..... 401/68, 75–78
See application file for complete search history.

(56) References Cited

U.S. PATENT DOCUMENTS

| | | | |
|---|---|---|---|
| 1,999,263 | A | 4/1935 | Thesmar |
| 2,815,122 | A | 12/1957 | Lerner et al. |
| 3,298,509 | A | 1/1967 | Hultgren |
| 4,505,607 | A | 3/1985 | Sugiyama |
| 5,172,993 | A | 12/1992 | Ackermann et al. |
| 5,186,560 | A | 2/1993 | Holloway |
| 5,186,561 | A | 2/1993 | Ackermann et al. |
| 5,324,125 | A | 6/1994 | Ackermann |
| 5,324,126 | A | 6/1994 | Holloway et al. |
| 5,348,410 | A | 9/1994 | Shozi et al. |
| 5,399,040 | A | 3/1995 | Holloway |

(Continued)

FOREIGN PATENT DOCUMENTS

| | | | |
|---|---|---|---|
| FR | 1118520 | A | 6/1956 |
| WO | WO1995001743 | A1 | 1/1995 |
| WO | WO2020127321 | | 6/2020 |

*Primary Examiner* — David J Walczak
(74) *Attorney, Agent, or Firm* — Thomas P. O'Connell; O'Connell Law Firm

(57) ABSTRACT

A refillable cosmetic dispenser with a cartridge for a stick cosmetic that can be locked in a retracted position except when engaged with a corresponding dispenser base. Locking formations retained by an elongate body and an elevator cup have a locked condition to lock the elevator cup against movement relative to the elongate body. The dispenser base receives the elongate body, and a release member of the dispenser base actuates the locking formations from the locked condition to the unlocked condition. The locking formations retained by the elongate body can be plural resiliently deflectable fingers disposed along a circular shape, and the release member can be a central column that is operative to deflect the resiliently deflectable fingers out of engagement with the locking formation of the elevator cup. The elevator cup can thus be locked in a retracted position to be freed by a corresponding dispenser base.

38 Claims, 12 Drawing Sheets

(56) References Cited

U.S. PATENT DOCUMENTS

| | | | | |
|---|---|---|---|---|
| 5,649,777 | A | 7/1997 | Holloway | |
| 5,791,799 | A | 8/1998 | Oehlhorn | |
| 5,842,805 | A | 12/1998 | Pierpont | |
| 5,851,078 | A | 12/1998 | Bow et al. | |
| 6,036,387 | A | 3/2000 | Gueret | |
| 6,126,351 | A | 10/2000 | Gueret | |
| 6,158,911 | A | 12/2000 | Seebach, Jr. et al. | |
| 6,200,047 | B1 | 3/2001 | Holloway | |
| 6,200,049 | B1 | 3/2001 | Pinhel et al. | |
| 6,231,254 | B1 | 5/2001 | Holloway | |
| 6,293,721 | B1 | 9/2001 | Bow et al. | |
| 6,412,999 | B1 | 7/2002 | Pierpont | |
| 6,543,953 | B1 | 4/2003 | Kim | |
| 7,325,991 | B2 | 2/2008 | Holloway | |
| 7,357,588 | B2 | 4/2008 | Liard | |
| 7,500,799 | B2 | 3/2009 | Holloway | |
| 9,433,276 | B2 | 9/2016 | McNamara et al. | |
| 9,474,349 | B2 | 10/2016 | Holloway | |
| 11,553,778 | B2 * | 1/2023 | Trochel | A45D 40/16 |
| 2007/0217857 | A1 | 9/2007 | Ho | |
| 2008/0283556 | A1 | 11/2008 | Snodgrass | |
| 2015/0296958 | A1 | 10/2015 | Holloway | |
| 2016/0015149 | A1 | 1/2016 | Kim et al. | |
| 2021/0068517 | A1 | 3/2021 | Trochel | |

* cited by examiner

REFILLABLE COSMETIC DISPENSER

FIELD OF THE INVENTION

The inner diameters of the body portions 36 and 44 of the inner body 14 and the spiral member 16 and the outer diameter of the peripheral wall 50 of the elevator cup 12 are calibrated to allow the elevator cup 12 to slide longitudinally within the inner body 14 and the spiral member 16, such as by having the outer diameter of the peripheral wall 50 be slightly less than the inner diameter of the body portion 36 of the inner body 14. Similarly, the elevator lugs 52 and the opposed spiral channels 46 are dimensioned to enable a sliding of the elevator lugs 52 along the spiral channels 46, such as by having the distance between the outer tips of the elevator lugs 52 slightly less than the distance between the opposed surfaces of the spiral channels 46.

BACKGROUND OF THE INVENTION

In a typical dispenser for a stick cosmetic, an elevator cup retains the cosmetic for axial extension and retraction by a rotation of a base portion relative to a body portion. Dispensers commonly employ a tubular cam member that is rotatably associated with a tubular inner body. The cam member has channels that communicate helically along the inner surface thereof, and the inner body has opposed longitudinal slots. Opposed lugs of an elevator cup, which retains the cosmetic, are received through the longitudinal slots to engage the helical channels of the cam member. A rotation of the cam member in relation to the inner body induces longitudinal travel of the elevator cup and the retained cosmetic as the lugs of the elevator cup slide along the helical channels of the cam member and are thereby driven along the longitudinal channels of the inner body. Relative rotation of the cam member and the inner body in a first direction will extend the elevator cup, and relative rotation of the cam member and the inner body in a second, opposite direction will retract the elevator cup.

Stick cosmetic dispensers have commonly been discarded once the cosmetic is exhausted. However, it has become desirable to be able to refill a cosmetic dispenser with a replacement cosmetic stick once a given cosmetic is spent or no longer desired. With disposable packaging increasingly recognized as wasteful and irresponsible, refillable cosmetic dispensers are appreciated as being more environmentally sound and efficient. By permitting the cosmetic to be refilled, greater resources can be expended in rendering the cosmetic dispenser an aesthetically desirable, luxury item. Accordingly, a cosmetic dispenser that is simultaneously environmentally friendly and imbibed with enhanced luxury and beauty is now a sought-after advance in the art.

While the ability to employ replaceable cosmetic refills in a cosmetic dispenser can thus be highly desirable, that very ability introduces certain challenges and creates the risk of known shortcomings. For example, it has been found that consumers sometimes use the refill structure and the retained cosmetic altogether independently of the cosmetic base for which they were designed. It has also been found that cosmetic refills of a given brand can be inserted and used relative to cosmetic dispensers of an entirely different brand so that producers of the cosmetic dispenser do not enjoy the sought after follow-on sales of the cosmetic refills.

The present inventors have thus recognized that there is a need for a refillable cosmetic dispenser and a cosmetic refill for such cosmetic dispensers that prevent use of the cosmetic refill independently and that prevent the use of third party cosmetic refills relative to a given party's cosmetic dispenser.

SUMMARY OF THE INVENTION

In view of the needs in the art relating to refillable cosmetic dispensers, the present inventors set forth with the broadly stated object of providing a cosmetic dispenser for stick cosmetics that can be efficiently refilled with dedicated cosmetic refills.

A further object of embodiments of the invention is to provide a refillable cosmetic dispenser that prevents the usage of non-dedicated cosmetic refills in relation thereto.

A related object of manifestations of the invention is to provide a cosmetic refill for a refillable cosmetic dispenser that prevents usage of the cosmetic refill in relation to non-dedicated refillable cosmetic dispensers.

An additional object of embodiments of the invention is to provide a cosmetic refill that is not operational independently of a cosmetic dispenser.

An underlying object of the invention is to provide a refillable cosmetic dispenser and cosmetic refills for such a refillable dispenser that minimize waste thereby to be environmentally sound.

A further object of embodiments of the invention is to provide a cosmetic dispenser that can be refilled and reused thereby to justify greater investments in luxury relative to the dispenser.

These and further objects, advantages, and details of the present invention will become obvious not only to one who reviews the present specification and drawings but also to those who have an opportunity to make use of an embodiment of the refillable cosmetic dispenser and cosmetic refills for such cosmetic dispensers disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, one embodiment of the refillable cosmetic dispenser for a stick cosmetic, such as a lipstick or any other stick cosmetic, has an elongate body with a proximal end and a distal end. An elevator cup is disposed within the elongate body for retaining a cosmetic stick. The elevator cup has at least one locking formation. An extension and retraction mechanism, which could be a rotary extension and retraction mechanism or any other extension and retraction mechanism, is provided for selectively adjusting the elevator cup between a retracted position and an extended position relative to the elongate body. At least one locking formation is retained by the elongate body. The locking formations retained by the elongate body and the elevator cup have a locked condition wherein the locking formations engage to lock the elevator cup against movement relative to the elongate body, and the locking formations have an unlocked condition wherein the locking formations are not engaged to lock the elevator cup against movement relative to the elongate body. In the locked condition, the locking formations could, for instance, engage to lock the elevator cup in a retracted position relative to the elongate body.

A dispenser base is provided for receiving the elongate body. The dispenser base has a release member that is operative to actuate the locking formations from the locked condition to the unlocked condition thereby to free the elevator cup for extension and retraction by operation of the extension and retraction mechanism. For instance, the dispenser base could comprise an elongate member, such as but not limited to an elongate tubular member, with the release member being fixed to the elongate member. Still more particularly, the release member could comprise a central column with a tip portion that is operative to actuate the locking formations from the locked condition to the unlocked condition with the tip portion thus comprising an unlocking formation.

Embodiments of the refillable cosmetic dispenser are disclosed wherein the at least one locking formation retained by the elongate body comprises a locking member attached to the elongate body. It is also within the scope of the invention for the locking member and the at least one locking formation to be integral with the elongate body.

The at least one locking formation retained by the elongate body can take the form of at least one resiliently deflectable member with the release member of the dispenser base being operative to deflect the at least one resiliently deflectable member out of engagement with the at least one locking formation of the elevator cup. Furthermore, it is disclosed that the at least one locking formation retained by the elongate body can comprise plural resiliently deflectable members with the release member of the dispenser base operative to deflect the plural resiliently deflectable members out of engagement with the at least one locking formation of the elevator cup. The plural resiliently deflectable members can be resiliently deflectable fingers, and they can be disposed along a circular shape projecting from a locking member that is attached to the elongate body.

In embodiments of the dispenser, the release member of the dispenser base can take the form of a member with a tip portion that is received between the plural resiliently deflectable members to deflect the plural resiliently deflectable members out of engagement with the at least one locking formation of the elevator cup. By way of example and not limitation, the release member of the dispenser base can comprise a central column. Moreover, each of the plural resiliently deflectable members can have an inwardly sloped proximal portion, and the tip portion of the release member can comprise a tapered tip portion for being received between the plural resiliently deflectable members to engage the inwardly sloped proximal portions.

Manifestations of the elevator cup can have a base portion with the at least one locking formation of the elevator cup projecting longitudinally from the base portion. Still more particularly, the at least one locking formation of the elevator cup can take the form of an annular hook structure with a round base wall that projects from the base portion of the elevator cup and an outwardly projecting annular ridge retained by the base wall. That annular hook structure could be separated into a plurality of hook members, each spanning an angular range.

Except as the claims might expressly require, the invention is not limited with respect to the particular type of extension and retraction mechanism. In one non-limiting example, the extension and retraction mechanism comprises a rotary extension and retraction mechanism. There, the elongate body can comprise an inner body, and a spiral member can be concentric with the inner body. The inner body has at least one longitudinal track therethrough, and the spiral member has at least one spiral formation. The elevator cup has a sidewall and at least one lug that projects from the sidewall, through the at least one longitudinal track, and into engagement with the at least one spiral formation. Under such embodiments, when the locking formations are in the unlocked condition, the elevator cup can be manipulated between the retracted position and the extended position by a relative rotation of the inner body and the spiral member.

According to the present invention, a refill cartridge for a refillable cosmetic dispenser for a stick cosmetic can be provided. The refill cartridge can, for example, have an elongate body with a proximal end and a distal end. An elevator cup is disposed within the elongate body for retaining a cosmetic stick. The elevator cup has at least one locking formation, and an extension and retraction mechanism is provided for selectively adjusting the elevator cup between a retracted position and an extended position relative to the elongate body. At least one locking formation is retained by the elongate body. The locking formations retained by the elongate body and the elevator cup have a locked condition wherein the locking formations engage to lock the elevator cup against movement relative to the elongate body, and the locking formations have an unlocked condition wherein the locking formations are not engaged to lock the elevator cup against movement relative to the elongate body. The locking formations can be biased to the locking formation whereby the elevator cup can be locked against movement relative to the elongate body absent actuation of the locking formations from the locked condition to the unlocked condition.

Also as disclosed herein, a dispenser base can be provided for a refillable cosmetic dispenser for a stick cosmetic, the dispenser base to be engaged with a corresponding refill cartridge. The dispenser base can thus have an elongate member for receiving the refill cartridge with the elongate member having a proximal end, a distal end, and a body portion with an inner volume. A release member is fixed to proximal end of the elongate member. The release member can, for example, comprise a central column with a tip portion that extends within the inner volume of the body portion from the proximal end of the body portion to comprise an unlocking formation for the refill cartridge.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The refillable cosmetic dispenser disclosed herein is subject to a variety of embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
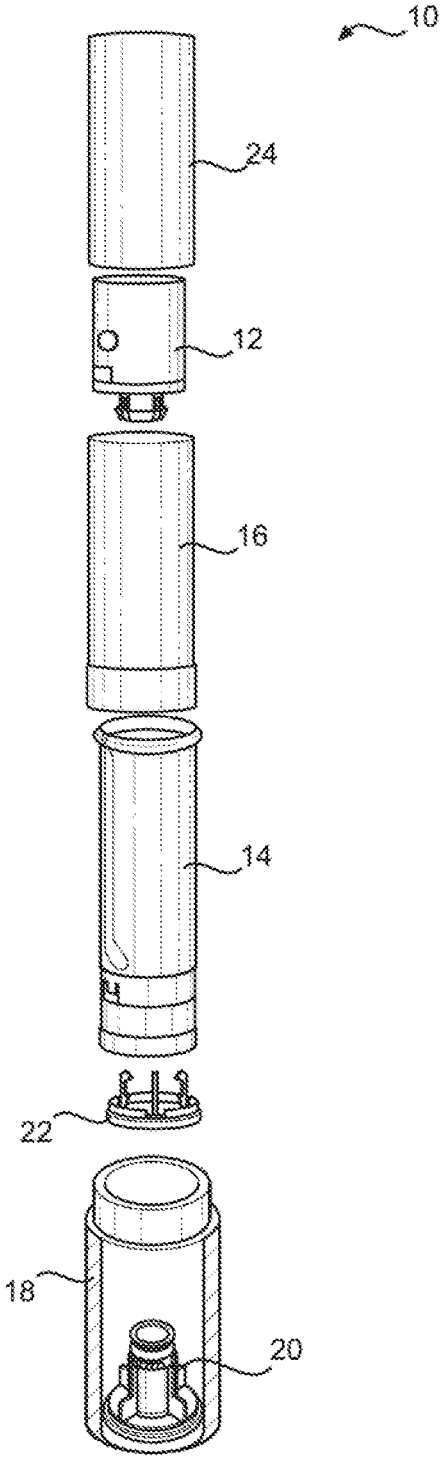
FIG. 1 is an exploded perspective view of a refillable cosmetic dispenser according to the present invention.
Figure 7:
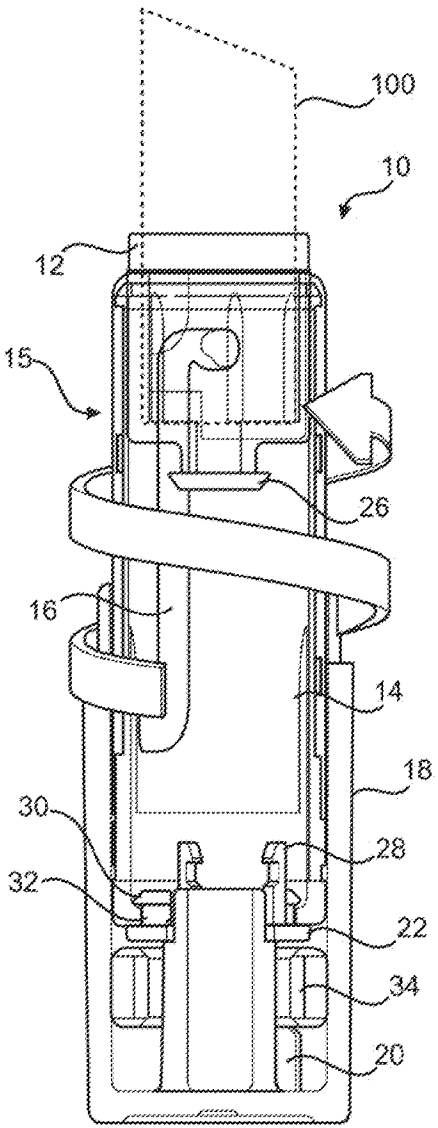
FIG. 7 is a cross-sectional elevational view of the cosmetic cartridge, locking ring, and cosmetic base fully assembled with the elevator cup in an extended position.
Figure 6:
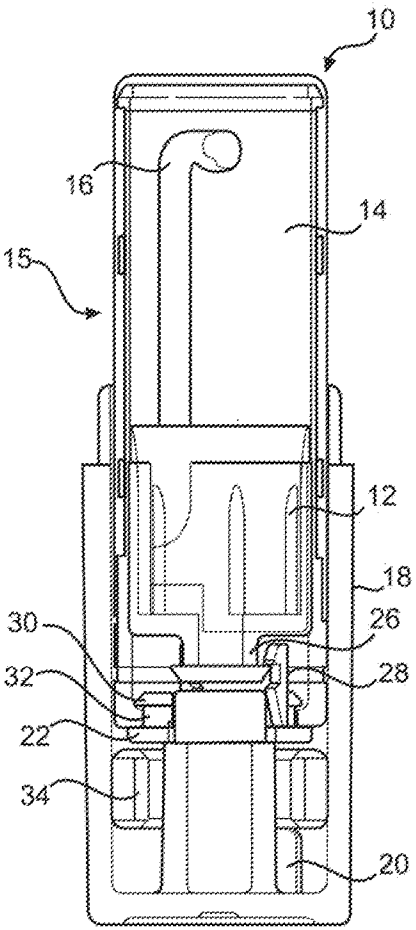
FIG. 6 is a cross-sectional elevational view of the cosmetic cartridge, locking ring, and cosmetic base fully assembled.
Figure 5:
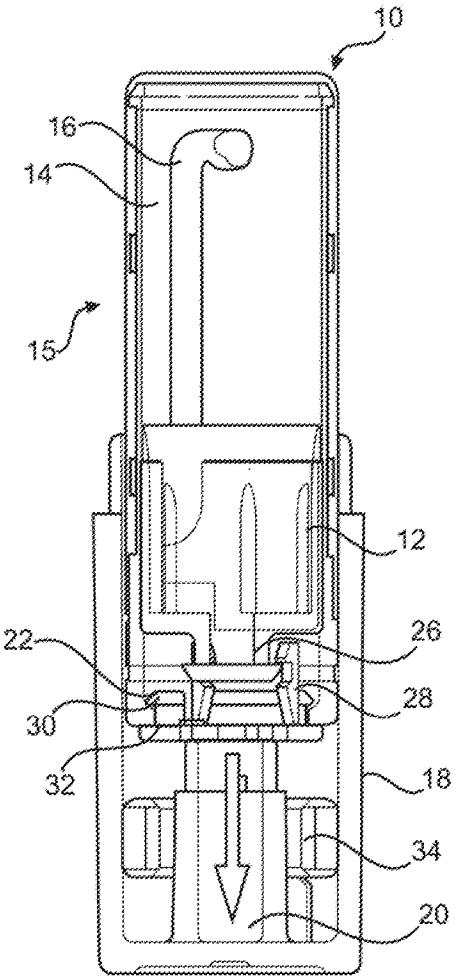
FIG. 5 is a cross-sectional elevational view of the assembled cosmetic cartridge and locking ring during a further stage of assembly with the cosmetic base.
Figure 8:
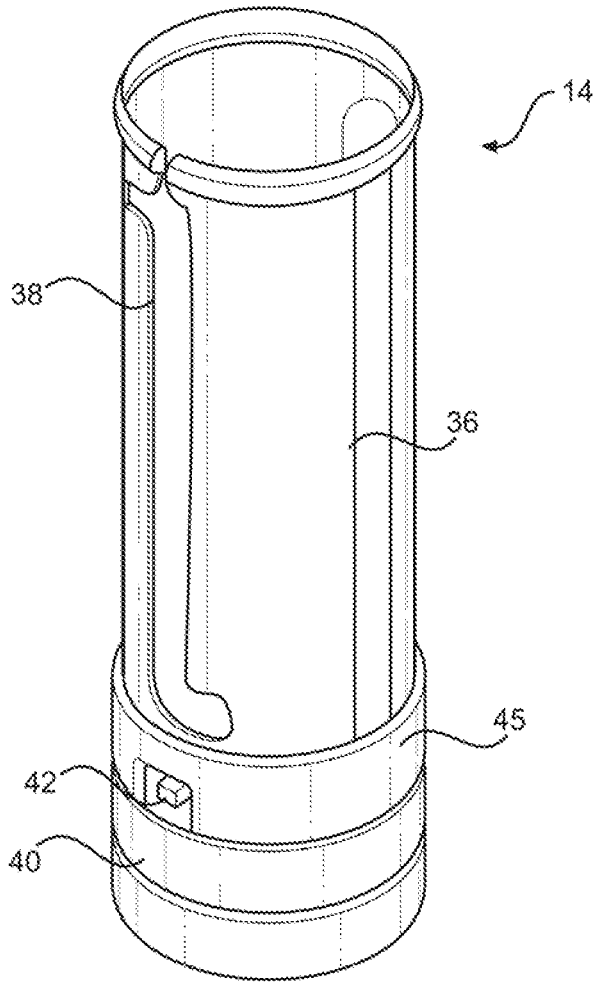
FIG. 8 is a perspective view of an inner body pursuant to the instant invention.
Figure 9:
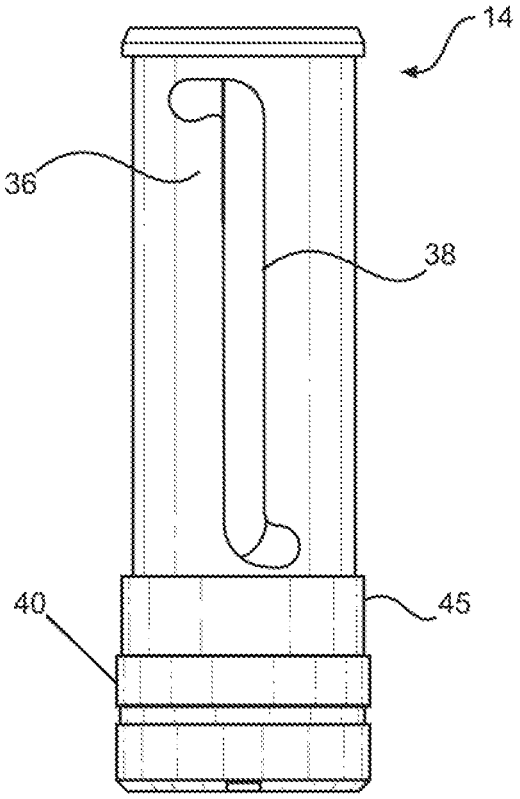
FIGS. 9, 10, and 11 are views of the inner body in front elevation, side elevation, and rear elevation, respectively.
Figure 10:
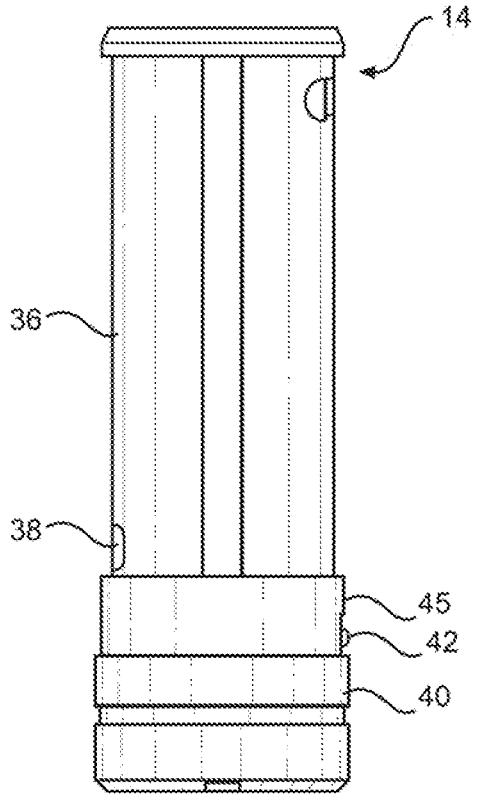
Figure 11:
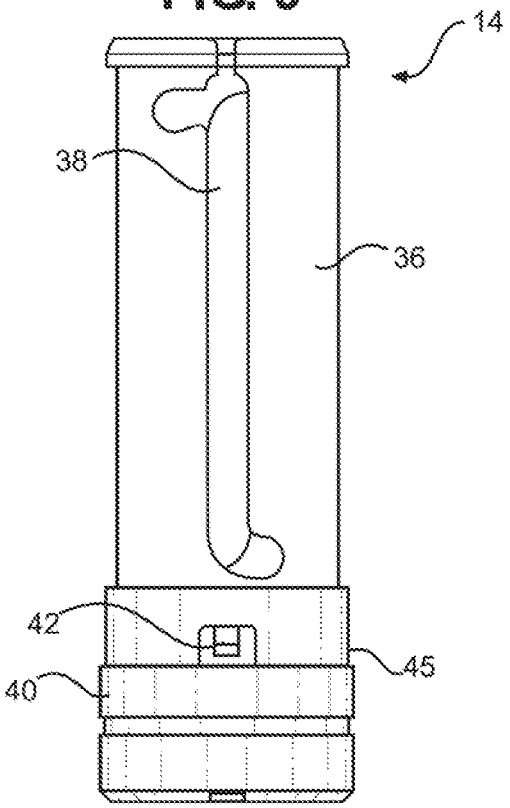
Figure 12:
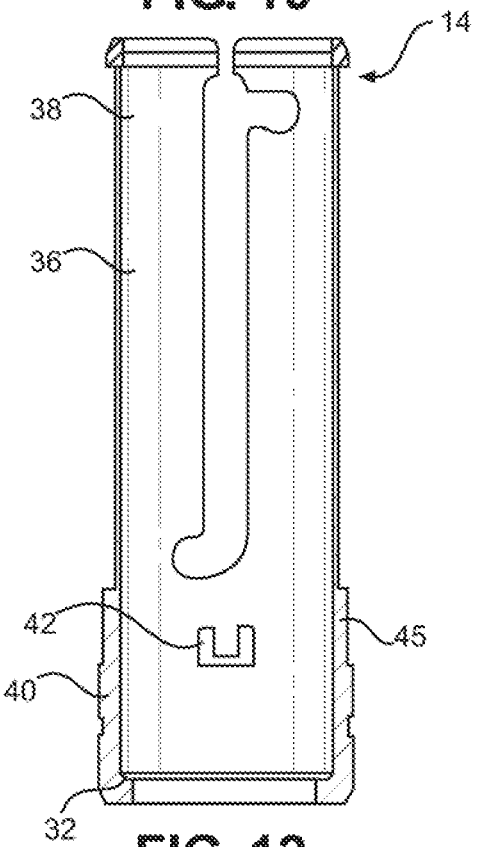
FIG. 12 is a view of the inner body in longitudinal cross section.

Turning more particularly to the drawings, a refillable cosmetic dispenser according to the invention is indicated generally at 10 in FIG. 1. The cosmetic dispenser 10 has a tubular inner body 14 that is rotatably engaged with a concentric outer body 16, which may alternatively be referred to as a spiral member 16. An elevator cup 12, which retains a stick cosmetic 100 as shown in FIG. 7 only, is retained to travel longitudinally within the inner body 14. A tubular shell 24, which can be essentially decorative in nature, partially or substantially encases the spiral member 16 and, derivatively, the elevator cup 12 and inner body 14 disposed therewithin. As shown in FIGS. 3 through 7, for instance, when the elevator cup 12, the inner body 14, the spiral member 16, and the shell 24 are fully assembled along with a locking ring 22, a refill cartridge 15 is formed.

The refill cartridge 15 is rendered operational by its full engagement with a corresponding dispenser base 18, and the refill cartridge 15 is prevented from operation when it is not engaged with a corresponding dispenser base 18. When the refill cartridge 15 is rendered operational through its engagement with the dispenser base 18, a relative rotation between the inner body 14 and the spiral member 16 in a first rotational direction, such as in a clockwise direction in the illustrated example, yields an axial extension of the elevator cup 12, and a relative rotation between the inner body 14 and the spiral member 16 in a second, opposite rotational direction yields an axial retraction of the elevator cup 12. Accordingly, when the cartridge 15 and the dispenser base 18 are fully engaged, the elevator cup 12, and thus a retained stick of cosmetic 100, can be selectively adjusted between the retracted disposition depicted, for instance, in FIG. 6 and the extended disposition depicted, for instance, in FIG. 7.

For ease of reference, the cosmetic dispenser 10 can be considered to have a proximal end defined as the closed bottom of the dispenser base 18 while the tip of the tubular shell 24 can be considered to define a distal end of the cosmetic dispenser 10. Each component of the cosmetic dispenser 10 can generally be described under that convention. It should be noted that, while terms such as member or the like are employed in relation to the spiral member 16 and possibly other components of the cosmetic dispenser 10, each could be formed unitarily as a single piece of material or from multiple subcomponents joined by any effective method to form the respective structure. Additionally, except as otherwise described or claimed, the elevator cup 12, the inner body 14, the spiral member 16, the components of the dispenser base 18, the tubular shell 24, and each other component of the cosmetic dispenser 10 can be formed from any suitable material and by any effective method.

The tubular inner body 14 is shown apart from the remainder of the refillable cosmetic dispenser 10 in the views of FIGS. 8 through 12. The inner body 14 has a distally disposed body portion 36 for being received into a body portion 44 of the spiral member 16, which is seen alone in FIGS. 13 and 14. The body portion 36 of the inner body 14 is tubular and has an outer diameter slightly less than the inner diameter of the body portion 44 of the spiral member 16. An annular base portion 40 of the inner body 14 is disposed at a proximal end of the inner body 14, such as by being formed integrally therewith, and a smooth annular bearing wall 45 is interposed between the body portion 36 and the base portion 40. The annular bearing wall 45 is concentric with the inner body 14 and is longitudinally aligned with the body portion 36 and the inner body 14 in general. The annular bearing wall 45 thereby presents what can be referred to as a lateral bearing surface, and lateral force can bear against the annular bearing wall 45.

The inner body 14 has first and second opposed longitudinal tracks 38 that communicate along a substantial length of the body portion 36 of the inner body 14. The longitudinal tracks 38 are disposed in general opposition and pass entirely through the body portion 36 to comprise slots. With this, the elevator lugs 52 of the elevator cup 12, which is shown in FIGS. 15 through 20 and is described further hereinbelow, pass through the longitudinal tracks 38 to engage the opposed spiral channels 46 of the spiral member 16 of FIGS. 13 and 14. As shown, the first longitudinal track 38 of the inner body 14 can have closed proximal and distal ends while the second longitudinal track 38 can have a closed proximal end while being open at the distal end thereof for enabling a receipt of the elevator lugs 52 of the elevator cup 12 and for enabling a radial compression of the body portion 36 of the inner body 14 during an insertion of the body portion 36 of the inner body 14 into the body portion 44 of the spiral member 16.

The first and second longitudinal tracks 38 in this embodiment have distal lateral track segments at the distal ends thereof and proximal lateral track segments at the proximal ends thereof. The distal lateral track segments can be employed to lock the elevator cup 12 in an extended disposition, and the proximal lateral track segments lock the elevator cup 12 in a retracted disposition. With this, inadvertent movement, namely unintended extension or retraction, of the elevator cup 12 and the retained cosmetic stick 100 is prevented.

The elevator cup 12 is shown apart from the remainder of the cosmetic dispenser 10 in FIGS. 15 through 20. The elevator cup 12 has an open inner volume for receiving a proximal portion of a member of lipstick (not shown in FIGS. 15 through 20). The open inner volume is defined by an annular peripheral wall 50 and a proximal base portion 56. A plurality of fins 54, each with a proximal end adjacent to the base portion 56, a body portion, and a distal end terminating at a given height along the peripheral wall 50, project radially inward from the peripheral wall 50. In the present embodiment, the fins 54 project along radii of the elevator cup 12, but other angular dispositions are possible. The fins 54 have a distal taper for enabling a most efficient receipt and engagement of the pomade of lipstick. The fins 54 are longitudinally aligned with the elevator cup 12 and the cosmetic dispenser 10 in general. First and second elevator lugs 52 project from opposed sides of the elevator cup 12 from a mid-portion of the peripheral wall 50 for passing through the longitudinal tracks 38 of the inner body 14 to be drivingly engaged with the helical channels 46 of the spiral member 16 as further shown and described herein.

Figure 13:
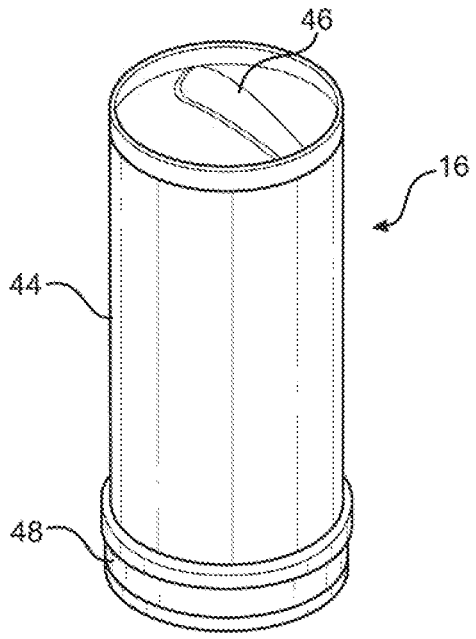
FIG. 13 is a perspective view of a spiral cam pursuant to the invention.
Figure 14:
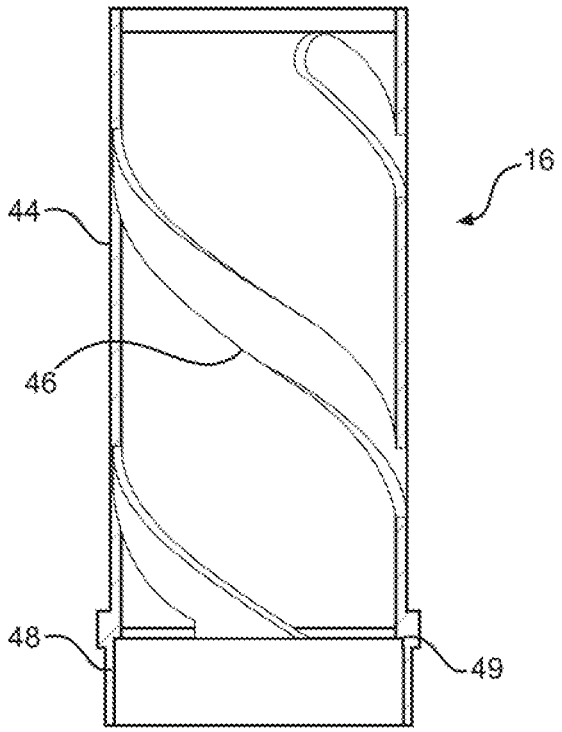
FIG. 14 is a view of the spiral cam in longitudinal cross section.
Figure 15:
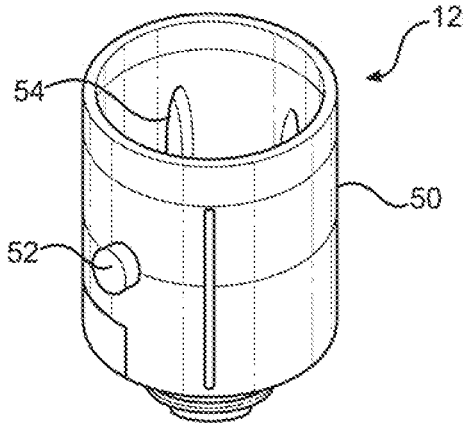
FIG. 15 is a perspective view of an elevator cup pursuant to the instant invention.
Figure 16:
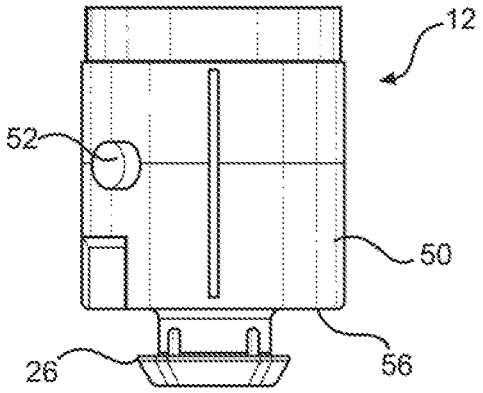
FIGS. 16 and 17 are elevational views of the elevator cup.
Figure 17:
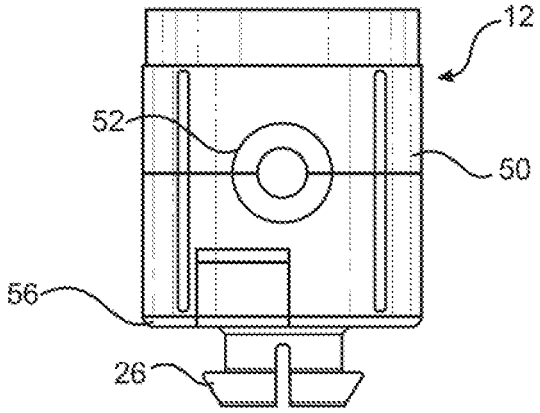
Figure 18:
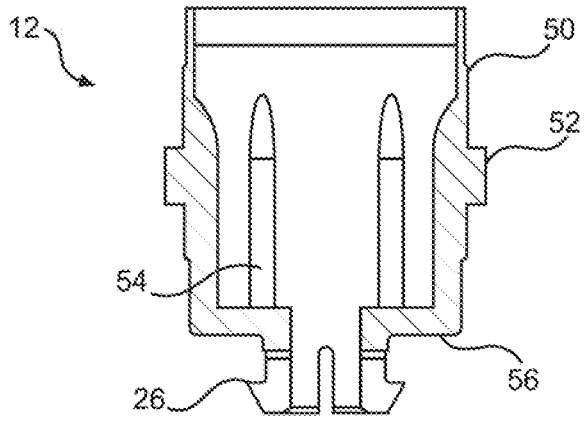
FIG. 18 is a view of the elevator cup in longitudinal cross section taken along the line 18-18 in FIG. 19.
Figure 19:
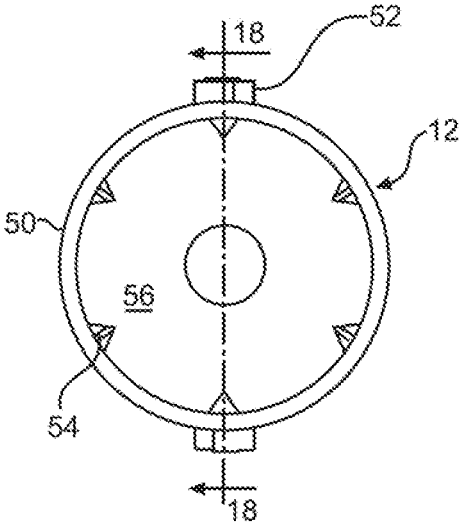
FIGS. 19 and 20 are top and bottom plan views of the elevator cup, respectively.
Figure 20:
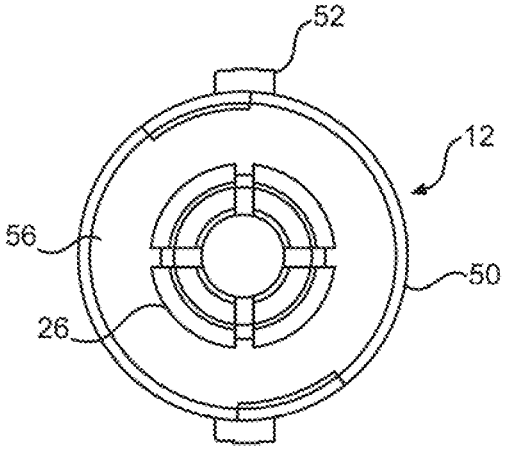
Figure 21:
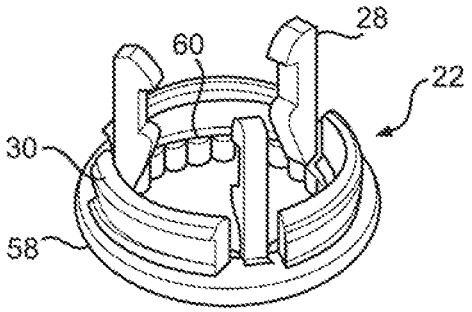
FIG. 21 is a perspective view of a locking ring according to the present invention.
Figure 22:
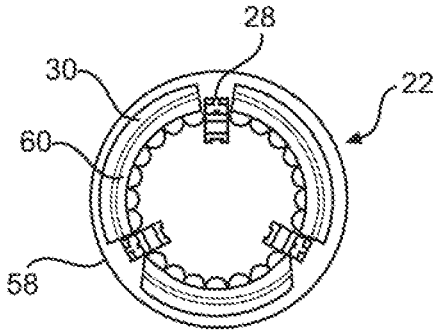
FIG. 22 is a top plan view of the locking ring.
Figure 24:
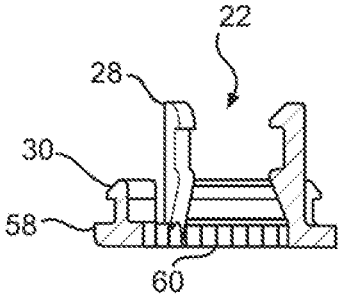
FIG. 24 is a cross-sectional view of the locking ring taken along the line 24-24 in FIG. 23.
Figure 23:
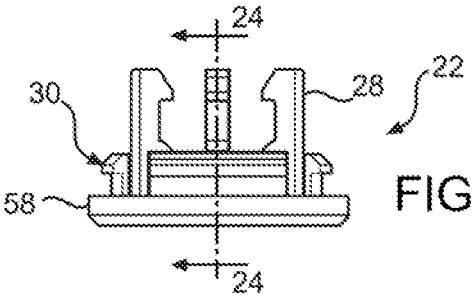
FIG. 23 is a view in front elevation of the locking ring.
Figure 25:
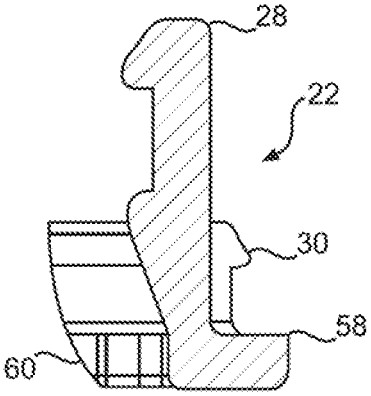
FIG. 25 is an amplified cross-sectional view of the encircled portion of the locking ring of FIG. 24.
Figure 26:
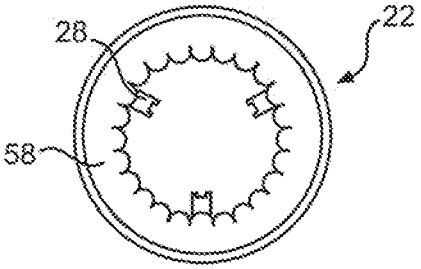
FIG. 26 is a bottom plan view of the locking ring.

As shown in FIGS. 13 and 14, the cylindrical spiral member 16 has a proximally disposed skirt 48 and the distally disposed body portion 44. The skirt 48, which is flexible, has an outer diameter greater than the outer diameter of the body portion 44. The tubular shell 24 can be disposed to encase the body portion 44 as seen, for example, in FIGS. 2 through 7. The spiral member 16 has an inwardly projecting annular shoulder 49 formed at the distal end of the skirt 48. With that, the inner body 14 can be received through the proximal end of the spiral member 16 until the distal end of the annular bearing wall 45 of the inner body 14 contacts the shoulder 49 of the spiral member 16. The outer shell 24 has an outer diameter approximately equal to the outer diameter of an outer shoulder portion of the skirt 48 and an inner diameter marginally larger than the outer diameter of the body portion 44 of the spiral member 16 whereby a substantially consistent cylindrical outer surface is established along the outer surface of the tubular shell 24 and the outer surface of shoulder portion of the skirt 48.

The inner diameter of the skirt 48 is marginally greater than the outer diameter of the annular bearing wall 45 of the inner body 14. One or more protuberances 42, which in this case comprise the end portions of resiliently deflectable fingers, project radially outward from the annular bearing wall 45 of the inner body 14 to establish a localized effective diameter greater than the undeflected inner diameter of the skirt 48. Under this construction, the protuberances 42 deflect and frictionally engage the skirt 48 thereby to create a frictional engagement between the inner body 14 and the spiral member 16 during a relative rotation therebetween. The pressing of the protuberances 42 against the skirt 48 provides smooth and consistent frictional resistance to the rotation of the inner body 14 relative to the spiral member 16.

Referring again to FIGS. 13 and 14, the body portion 44 of the spiral member 16 has a smooth outer wall surface and an inner wall surface with spiral formations 46, which in this example comprise spiral channels 46, that communicate helically therealong. It will be noted that, although spiral channels 46 are depicted in the instant embodiment, the spiral formations 46 alternatively could comprise spiral threads, spiral ridges, or any other spiral or helical arrangement. As in the present embodiment, first and second spiral channels 46 or other spiral formations 46 are disposed in general opposition to one another thereby to enable the spiral channels 46 to receive and drive the opposed elevator lugs 52 of the elevator cup 12.

The inner diameters of the body portions 36 and 44 of the inner body 14 and the spiral member 16 and the outer diameter of the peripheral wall 50 of the elevator cup 12 are calibrated to allow the elevator cup 12 to slide longitudinally within the inner body 14 and the spiral member 16, such as by having the outer diameter of the peripheral wall 60 be slightly less than the inner diameter of the body portion 36 of the inner body 14. Similarly, the elevator lugs 52 and the opposed spiral channels 46 are dimensioned to enable a sliding of the elevator lugs 52 along the spiral channels 46, such as by having the distance between the outer tips of the elevator lugs 52 slightly less than the distance between the opposed surfaces of the spiral channels 46.

As set forth previously, the refill cartridge 15 is rendered operational only by its full engagement with a correspondingly-designed dispenser base 18, and the refill cartridge 15 is prevented from operation when it is not engaged with a corresponding dispenser base 18. When the refill cartridge 15 is not operational, the elevator cup 12 and a retained cosmetic stick 100 are locked in a retracted position by a locking member 22, which in the present embodiment comprises a locking ring 22. The locking ring 22 has a locking configuration where the elevator cup 12 is locked against extension and an unlocked configuration where the elevator cup 12 is freed for extension and retraction. A release member 20, which in the present embodiment comprises a center post release member 20, is retained by tubular elongate member 62 of the dispenser base 18. When the refill cartridge 15 is fully engaged with a corresponding dispenser base 18, the release member 20 actuates the locking member 22 from the locking configuration where the elevator cup 12 is locked against extension to the unlocked configuration where the elevator cup 12 is freed to be selectively extended and retracted.

Operation of the locking member 22 and the release member 20 in this non-limiting embodiment can be further understood with reference to FIGS. 2 through 7 where the progressive engagement of the locking member 22 with the remainder of the cartridge 15 and the engagement of the cartridge 15 with the dispenser base 18 is shown. Further reference will be had to the views of the elevator cup 12 of FIGS. 15 through 20, to the views of the locking member 22 of FIGS. 21 through 26, and still further to the depictions of the center post release member 20 of FIGS. 32 through 37.

The locking member 22 has a plurality of locking formations 28 that project generally longitudinally from an annular cap portion 58 of the locking member 22, and the elevator cup 12 has one or more locking formations 26 that project generally longitudinally from the base portion 56 of the elevator cup 12. When the elevator cup 12 is in a retracted disposition and the cartridge 15 is not fully engaged with a corresponding cosmetic base 18, the locking formations 28 of the locking member 22 engage and restrain the locking formations 26 of the elevator cup 12 thereby to lock the elevator cup 12 in the retracted disposition.

In the embodiment depicted, the locking formations 26 of the elevator cup 12 are formed as portions of an annular hook structure. The annular hook structure has a round base wall that projects from the base portion 56 of the elevator cup 12 and an outwardly projecting annular ridge at the end of the base wall to form an annular hook. The annular hook is separated into portions to form a plurality of hook members as the locking formations 26, each arcuate in lateral cross section and each spanning an angular range.

The locking formations 28 of the locking member 22 comprise resiliently deflectable locking fingers 28, each with an inwardly sloped proximal portion and a distal hook portion. The locking formations 28 are disposed along a circular shape and are biased by their resiliency inward to the locked position. The tips of the hook portions are disposed along a circular shape with a circumference smaller than a circumference of a circle along which the annular ridges of the locking formations 26 of the elevator cup 12 are disposed. The locking member 22 further has an annular locking ridge 30 for permitting the locking member 22 to be snapped into the proximal end of the inner body 14 where the locking ridge 30 engages an inwardly projecting annular ridge 32 of the inner body 14.

Figure 4:
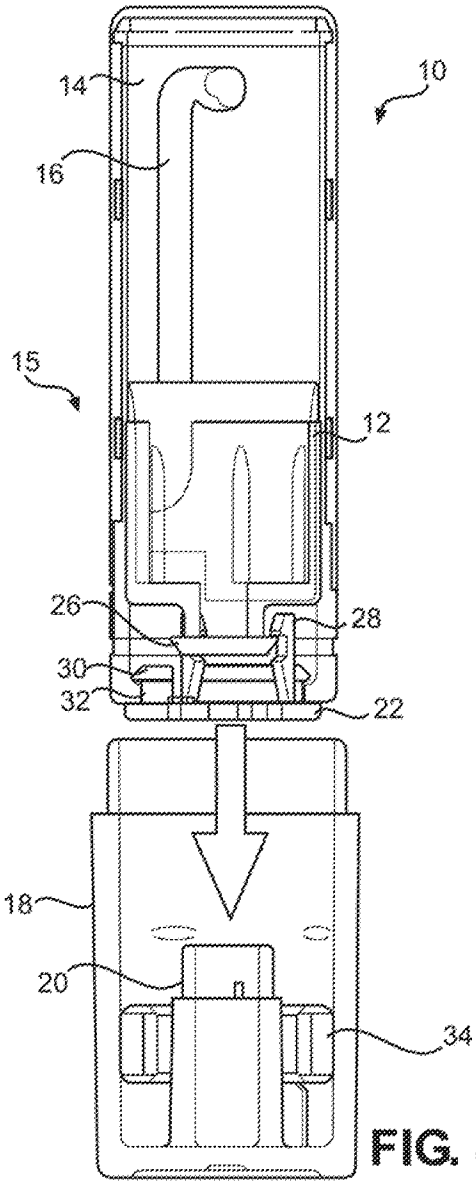
FIG. 4 is a cross-sectional elevational view of the assembled cosmetic cartridge and locking ring during a stage of assembly with a cosmetic base as disclosed herein.
Figure 3:
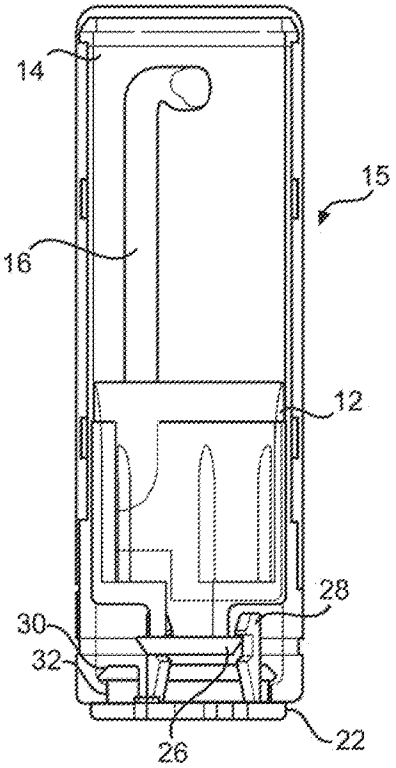
FIG. 3 is a cross-sectional elevational view of the cosmetic cartridge and locking ring in a further stage of assembly.
Figure 2:
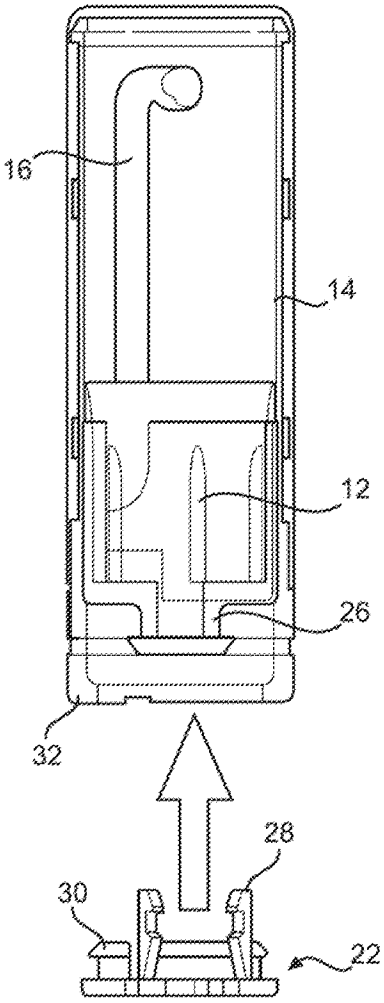
FIG. 2 is a cross-sectional elevational view of a cosmetic cartridge during a stage of assembly with a locking ring according to the invention.

Under the foregoing structure, the locking ring 22 can be snapped into the proximal end of the inner body 14 as shown, for instance, in FIGS. 2 through 4. With the elevator cup 12 in a retracted position adjacent to the proximal end of the inner body 14, the locking formations 28 of the locking ring 22 will be outwardly deflected as the hook portions thereof pass over the hook portions of the locking formations 26 of the elevator cup 12. Once the hook portions of the locking formations 26 and 28 pass over one another, the locking formations 28 of the locking ring 22 snap inwardly to a locked position in relation to the locking formations 26 of the elevator cup 12 as shown in FIG. 3, for example, thereby to prevent the elevator cup 12 from being moved from the retracted position.

The cosmetic dispenser base 18 has a release member 20 that is operative to disengage the locking formations 28 of the locking ring 22 from the locking formations 26 of the elevator cup 12 when the refill cartridge 15 is fully inserted into the dispenser base 18. More particularly, the release member 20 of the cosmetic dispenser base 18 operates to push the locking formations 28 of the locking ring 22 outwardly thereby to disengage the hook portions of the locking formations 28 of the locking ring 22 from the hook portions of the locking formations 26 of the elevator cup 12. When pushed outwardly by the release member 20, the hook portions of the locking formations 28 of the locking ring 22 are disposed along a circle with a circumference greater than the circumference of the circle along which the hook portions of the locking formations 26 of the elevator cup 12 are disposed. By operation of the release member 20, the elevator cup 12 is thus freed from the locking ring 22 and can be extended and retracted in a fully functional manner.

Figure 31:
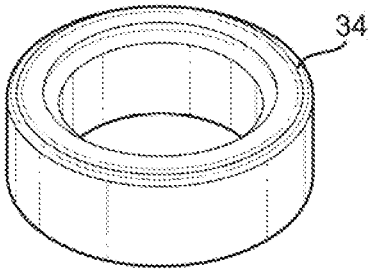
FIG. 31 is a perspective view of a weight for the refillable cosmetic dispenser.
Figure 32:
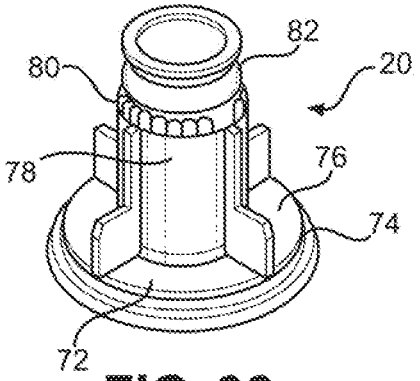
FIG. 32 is a perspective view of a release member for the refillable cosmetic dispenser.
Figure 33:
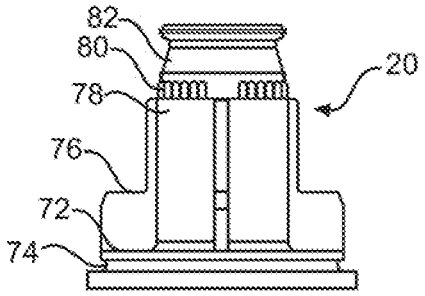
FIG. 33 is a view in front elevation of the release member.
Figure 34:
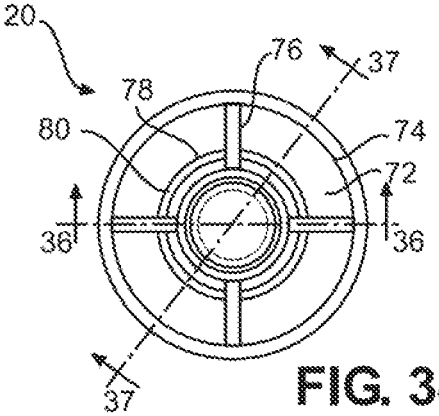
FIGS. 34 and 35 are top and bottom plan views of the release member respectively.
Figure 35:
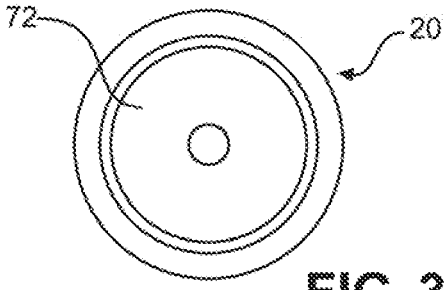
Figure 36:
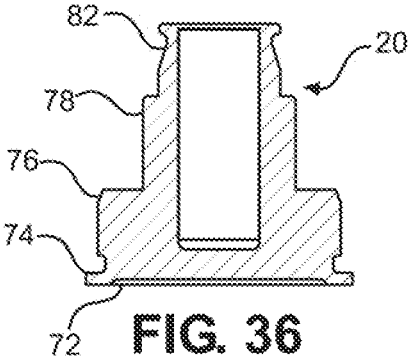
FIG. 36 is a cross-sectional view of the release member taken along the line 36-36 in FIG. 34.
Figure 37:
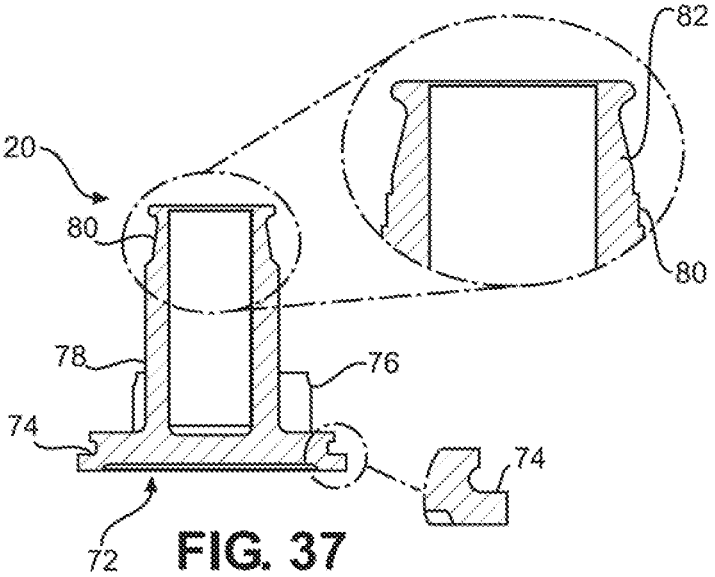
FIG. 37 is a cross-sectional view of the release member taken along the line 37-37 in FIG. 34 with amplified depictions of the encircled portions of the release member.

The structure and function of the release member 20 in this embodiment can be further understood with added reference to FIGS. 32 through 37. When the cosmetic dispenser 10 is fully assembled, the release member 20 is fixed within the proximal portion of the elongate tubular member 62 of the dispenser base 18, such as by integral formation or, as here, by being fitted into place. The release member 20 has a round base plate 72 with a peripheral channel 74 so that the release member 20 can be snap fit into engagement with an annular ridge 66 of the dispenser base 18. A central column 78 projects concentrically from the base member 72. A plurality of fins 76 with L-shaped profiles project radially from the central column 78. The L-shaped fins 76, which are four in number in this non-limiting example, establish a shoulder for supporting an annular weight 34, which is shown alone in FIG. 31. The central column 78 projects beyond the fins 76 and, in the manifestation of FIGS. 32 through 37, has a tapered tip portion 82 with an annular shoulder at the proximal end of the tip portion 82. The tip portion 82 is sized to have an outer circumference greater over at least a portion thereof than the circumference of a circle along which at least the narrowest portions the sloped surfaces of the locking formations 28 of the locking member 22 are disposed. For instance, the outer circumference of the area of the tip portion 82 that is disposed in contact with the locking formations 28 when the cartridge 15 and the dispenser base 18 are fully engaged can be greater than the circumference along the contacting portions of the locking formations 28 by an amount sufficient to displace the hook portions of the locking formations 28 from the hook portions of the locking formations 26. The tip portion 82 of the release member 20 can thus be referred to as an unlocking formation.

In certain refillable cosmetic dispensers 10, even further restriction on the operation of the refill cartridge 15 can be achieved by keying particular refill cartridges 15 to particular dispenser bases 18. In one such example as illustrated, the inner surface of the ring-shaped annular cap portion 58 of the locking member 22 can be formed with a particular pattern of formations 60, such as ribs or other formations 60, and the central column 78 of the release member 20 can have a corresponding pattern of formations 80, which again can be ribs or other formations, disposed around the central column 78 at the base of the tapered tip portion 82. With that, only refill cartridges 15 with a pattern of formations 60 matching the pattern of formations 80 of the dispenser base 18 can be used with that dispenser base 18, and a given dispenser base 18 can then be used only with refill cartridges 15 having patterns of formations 60 matching the pattern of formations 80 of the dispenser base 18.

Under the foregoing construction, the refill cartridge 15 can be assembled as in FIGS. 1 through 3. To do so, the elevator cup 12 is concentrically disposed within the inner body 14. The inner body 14 is concentrically disposed within the spiral member 16 with the lugs 52 of the elevator cup 12 received within the spiral channels 46 of the spiral member 16, and the cylindrical shell 24, commonly referred to as an A-shell, is disposed to encase the spiral member 16. To complete the refill cartridge 15, the locking member 22 is snapped into the proximal end of the inner body 14, and the locking formations 28 of the locking member 22 are engaged with the locking formations 26 of the elevator cup 12. The elevator cup 12 and a cosmetic stick 100 retained thereby are thus locked in a retracted position and prevented from normal operation.

To be rendered operational, the refill cartridge 15 must be fully disposed within a corresponding dispenser base 18 as in FIGS. 4 through 7. There, the proximal end of the refill cartridge 15 is inserted into the correspondingly configured dispenser base 18. As the tip portion 82 of the central column 78 of the release member 20 engages the locking formations 28 of the locking member 22, the tip portion 82 acts as an unlocking formation. The locking formations 28 of the locking member 22 are progressively driven out of engagement with the locking formations 26 of the elevator cup 12 such that the elevator cup 12 is no longer be restrained against longitudinal movement, and the cosmetic dispenser 10 is operational.

Figure 27:
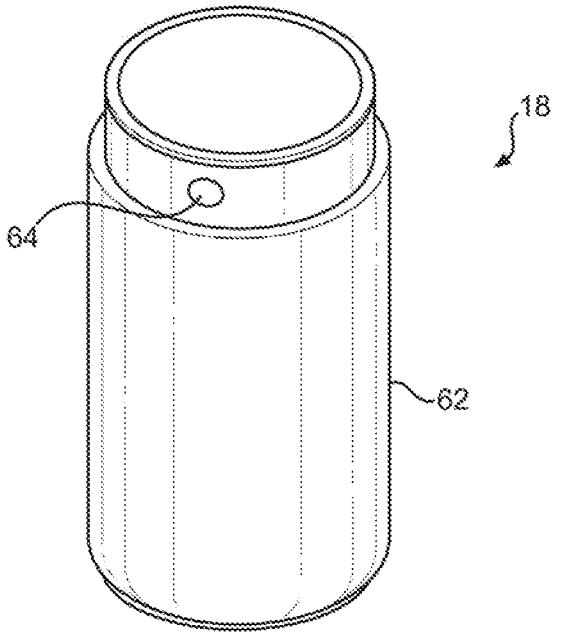
FIG. 27 is a perspective view of a dispenser base pursuant to the invention.
Figure 28:
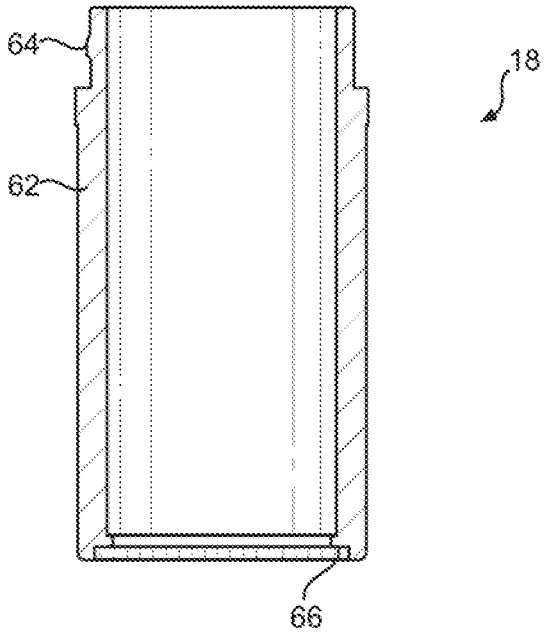
FIG. 28 is a view of the elongate member of the dispenser base in longitudinal cross section prior to receiving the release member.
Figure 29:
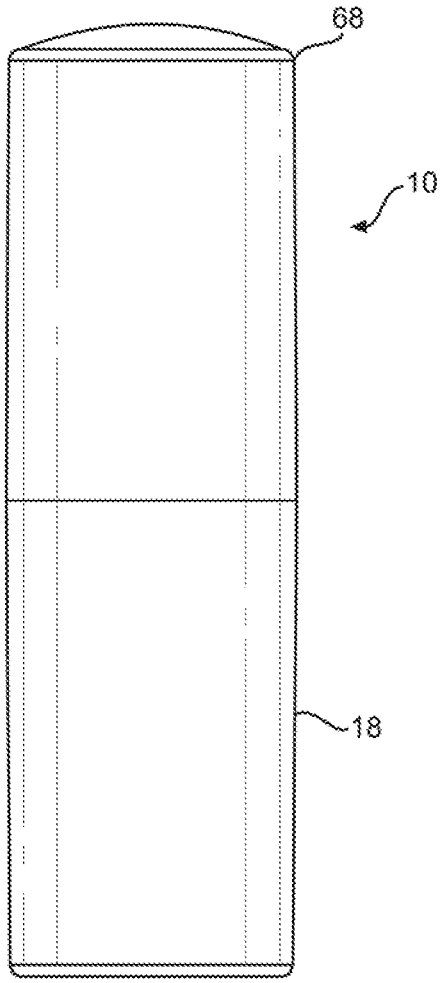
FIG. 29 is a view in front elevation of the refillable cosmetic dispenser in fully assembled form.
Figure 30:
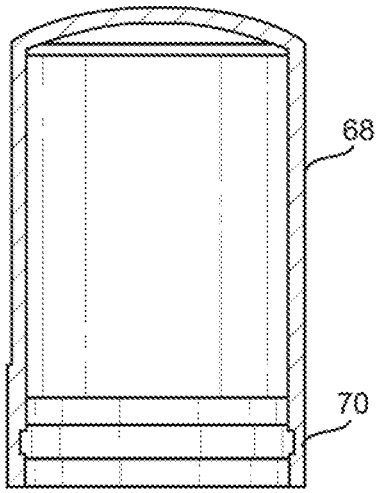
FIG. 30 is a view of a cap of the refillable cosmetic dispenser in longitudinal cross section.

During periods of nonuse, a dispenser cap 68 as shown in FIG. 30 can be snapped in place atop the dispenser base 18 as in FIG. 29. As FIGS. 27 and 28 show, the dispenser base 18 has one or more protuberances 64 for engaging a channel 70 along the inner surface of the dispenser cap 68 to retain the dispenser base 18 and the dispenser cap 68 in engagement.

When the cartridge 15 is rendered operational by its engagement with a corresponding dispenser base 18, the elevator cup 12, the inner body 14, and the spiral member 16 cooperate to form a rotary extension and retraction mechanism. By the engagement of the release member 20 with the locking member 22, the inner body 14 is rotationally fixed relative to the dispenser base 18. Further, the shell 24 is rotationally fixed relative to the spiral member 16. The inner body 14 can then be manually rotated in relation to the spiral member 16 by, for instance, a gripping of the dispenser base 18 and a relative rotation of the base 18 and the shell 24. The elevator cup 12, and thus a lipstick member 100 retained by the elevator cup 12 as in FIG. 7, can be manipulated between the retracted configuration depicted in FIG. 6 and the extended configuration depicted in FIG. 7 by a rotation of the inner body 14 in relation to the spiral member 16.

As the inner body 14 is rotated in relation to the spiral member 16, the elevator cup 12 is prevented from rotating in relation to the inner body 14 by engagement of the lugs 52 with the longitudinal tracks 38 of the inner body 14. With that, the lugs 52 of the elevator cup 12 slide along the helical channels 46 of the spiral member 16 to yield an axial movement of the elevator cup 12 and the retained lipstick 100. Relative rotation in a first direction will induce an extension of the elevator cup 12 while relative rotation in a second, opposite direction will induce a retraction of the elevator cup 12 and the retained cosmetic stick 100. When desired, such as when a given stick cosmetic 100 is spent or when a different color or type of cosmetic 100 is desired, a user can disengage the cartridge 15 retaining the cosmetic 100 to be replaced from the dispenser base 18 and insert a different cartridge 15 into the cosmetic base 18.

It will be understood that terms of orientation may be referenced herein merely provide a complete understanding of the disclosed refillable cosmetic dispenser 10 and are not limiting of the invention. Other nomenclature and conventions may be used without limitation of the teachings herein. Furthermore, the various components disclosed herein are merely illustrative and are not limiting of the invention. For example, except as limited by the claims, each of the components discussed herein may include subcomponents that collectively provide for the structure and function of the disclosed component. Furthermore, one or more components, sometimes referred to as members or otherwise herein, could be combined as a unitary structure while still corresponding to the disclosed components. Additional components that provide additional functions, or enhancements to those introduced herein, may be included. For example, additional components and materials, combinations of components or materials, and perhaps the omission of components or materials may be used to create embodiments that are nonetheless within the scope of the teachings herein.

When introducing elements of the present invention or embodiments thereof, the articles "a," "an," and "the" are intended to mean that there are one or more of the elements. The terms "comprising," "including," and "having" are intended to be inclusive such that there may be additional elements other than the listed elements. As used herein, the term "example" or "exemplary" is not intended to imply a superlative example. Rather, "exemplary" refers to an embodiment that is one of many possible embodiments.

With certain details and embodiments of the present invention for a refillable cosmetic dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally cognizable equivalents thereof.

We claim as deserving the protection of Letters Patent:

1. A refillable cosmetic dispenser for a stick cosmetic, the cosmetic dispenser comprising:

an elongate body with a proximal end and a distal end;

an elevator cup disposed within the elongate body for retaining the stick cosmetic wherein the elevator cup has at least one locking formation;

an extension and retraction mechanism for selectively adjusting the elevator cup between a retracted position and an extended position relative to the elongate body;

at least one locking formation retained by the elongate body;

wherein the locking formations retained by the elongate body and the elevator cup have a locked condition wherein the locking formations engage to lock the elevator cup against movement relative to the elongate body and wherein the locking formations have an unlocked condition wherein the locking formations are not engaged to lock the elevator cup against movement relative to the elongate body; and a dispenser base for receiving the elongate body wherein the dispenser base has a release member that is operative to actuate the locking formations from the locked condition to the unlocked conditions;

wherein the elevator cup has a base portion, wherein the at least one locking formation of the elevator cup projects longitudinally from the base portion, and wherein the at least one locking formation of the elevator cup comprises a hook structure with an outwardly projecting ridge.

2. The refillable cosmetic dispenser of claim 1 wherein the at least one locking formation retained by the elongate body comprises a locking member attached to the elongate body.

3. The refillable cosmetic dispenser of claim 1 wherein the hook structure comprises an annular hook structure with a round base wall that projects from the base portion of the elevator cup and wherein the outwardly projecting ridge comprises an outwardly projecting annular ridge retained by the base wall.

4. The refillable cosmetic dispenser of claim 3 wherein the annular hook structure is separated into a plurality of hook members, each spanning an angular range.

5. The refillable cosmetic dispenser of claim 1 wherein the at least one locking formation retained by the elongate body comprises plural resiliently deflectable members and wherein the release member of the dispenser base is operative to deflect the plural resiliently deflectable members out of engagement with the at least one locking formation of the elevator cup.

6. The refillable cosmetic dispenser of claim 5 wherein the plural resiliently deflectable members comprise resiliently deflectable fingers wherein the plural resiliently deflectable fingers are disposed along a circular shape.

7. The refillable cosmetic dispenser of claim 6 wherein the release member of the dispenser base comprises a member with a tip portion that is received between the plural resiliently deflectable members to deflect the plural resiliently deflectable members out of engagement with the at least one locking formation of the elevator cup.

8. The refillable cosmetic dispenser of claim 5 wherein the plural resiliently deflectable members project from a locking member that is attached to the proximal end of the elongate body.

9. The refillable cosmetic dispenser of claim 1 wherein the dispenser base further comprises an elongate member and wherein the release member is fixed to the elongate member.

10. The refillable cosmetic dispenser of claim 9 wherein the release member comprises a central column with a tip portion that is operative to actuate the locking formations from the locked condition to the unlocked condition whereby the tip portion comprises an unlocking formation.

11. The refillable cosmetic dispenser of claim 1 wherein the extension and retraction mechanism comprises a rotary extension and retraction mechanism wherein the elongate body comprises an inner body and further comprising a spiral member concentric with the inner body wherein the inner body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby, when the locking formations are in the unlocked condition, the elevator cup can be manipulated between the retracted position and the extended position by a relative rotation of the inner body and the spiral member.

12. A refillable cosmetic dispenser for a stick cosmetic, the cosmetic dispenser comprising:

an elongate body with a proximal end and a distal end;

an elevator cup disposed within the elongate body for retaining the stick cosmetic wherein the elevator cup has at least one locking formation;

an extension and retraction mechanism for selectively adjusting the elevator cup between a retracted position and an extended position relative to the elongate body;

at least one locking formation retained by the elongate body;

wherein the locking formations retained by the elongate body and the elevator cup have a locked condition wherein the locking formations engage to lock the elevator cup against movement relative to the elongate body and wherein the locking formations have an unlocked condition wherein the locking formations are not engaged to lock the elevator cup against movement relative to the elongate body;

a dispenser base for receiving the elongate body wherein the dispenser base has a release member that is operative to actuate the locking formations from the locked condition to the unlocked condition; and wherein the at least one locking formation retained by the elongate body comprises at least one resiliently deflectable member and wherein the release member of the dispenser base is operative to deflect the at least one resiliently deflectable member out of engagement with the at least one locking formation of the elevator cup.

13. The refillable cosmetic dispenser of claim 12 wherein the at least one locking formation retained by the elongate body comprises plural resiliently deflectable members and wherein the release member of the dispenser base is operative to deflect the plural resiliently deflectable members out of engagement with the at least one locking formation of the elevator cup.

14. The refillable cosmetic dispenser of claim 13 wherein the plural resiliently deflectable members comprise resiliently deflectable fingers wherein the plural resiliently deflectable fingers are disposed along a circular shape.

15. The refillable cosmetic dispenser of claim 13 wherein the plural resiliently deflectable members are disposed along a circular shape and wherein the release member of the dispenser base comprises a member with a tip portion that is received between the plural resiliently deflectable members to deflect the plural resiliently deflectable members out of engagement with the at least one locking formation of the elevator cup.

16. The refillable cosmetic dispenser of claim 15 wherein the release member of the dispenser base comprises a central column.

17. The refillable cosmetic dispenser of claim 15 wherein each of the plural resiliently deflectable members has an inwardly sloped proximal portion.

18. The refillable cosmetic dispenser of claim 15 wherein the tip portion of the release member comprises a tapered tip portion for being received between the plural resiliently deflectable members.

19. The refillable cosmetic dispenser of claim 15 wherein the plural resiliently deflectable members project from a locking member attached to the elongate body.

20. A refillable cosmetic dispenser for a stick cosmetic, the cosmetic dispenser comprising:

an elongate body with a proximal end and a distal end;

an elevator cup disposed within the elongate body for retaining the stick cosmetic wherein the elevator cup has at least one locking formation;

an extension and retraction mechanism for selectively adjusting the elevator cup between a retracted position and an extended position relative to the elongate body;

at least one locking formation retained by the elongate body;

wherein the locking formations retained by the elongate body and the elevator cup have a locked condition wherein the locking formations engage to lock the elevator cup against movement relative to the elongate body and wherein the locking formations have an unlocked condition wherein the locking formations are not engaged to lock the elevator cup against movement relative to the elongate body;

a dispenser base for receiving the elongate body wherein the dispenser base has a release member that is operative to actuate the locking formations from the locked condition to the unlocked condition; and wherein the locking formations retained by the elongate body and the elevator cup have a locked condition wherein the locking formations engage to lock the elevator cup in a retracted position relative to the elongate body.

21. A refillable cosmetic dispenser for a stick cosmetic, the cosmetic dispenser comprising:

an elongate body with a proximal end and a distal end wherein the elongate body has at least one longitudinal track therethrough;

a spiral member concentric with the elongate body wherein the spiral member has at least one spiral formation;

an elevator cup disposed within the elongate body for retaining the stick cosmetic wherein the elevator cup has at least one locking formation, a sidewall, and at least one lug that projects from the sidewall, through the longitudinal track, and into engagement with the spiral formation;

at least one locking formation retained by the elongate body wherein the at least one locking formation retained by the elongate body comprises at least one resiliently deflectable member;

wherein the locking formations retained by the elongate body and the elevator cup have a locked condition wherein the locking formations engage to lock the elevator cup against movement relative to the elongate body and wherein the locking formations have an unlocked condition wherein the locking formations are not engaged to lock the elevator cup against movement relative to the elongate body; and a dispenser base for receiving the elongate body wherein the dispenser base has a release member that is operative to actuate the locking formations from the locked condition to the unlocked condition by deflecting the at least one resiliently deflectable member out of engagement with the at least one locking formation of the elevator cup.

22. The refillable cosmetic dispenser of claim 21 wherein the at least one locking formation retained by the elongate body comprises plural resiliently deflectable members and wherein the release member of the dispenser base is operative to deflect the plural resiliently deflectable members out of engagement with the at least one locking formation of the elevator cup.

23. The refillable cosmetic dispenser of claim 22 wherein the plural resiliently deflectable members comprise resiliently deflectable fingers wherein the plural resiliently deflectable fingers are disposed along a circular shape.

24. The refillable cosmetic dispenser of claim 22 wherein the release member of the dispenser base comprises a member with a tip portion that is received between the plural resiliently deflectable members to deflect the plural resiliently deflectable members out of engagement with the at least one locking formation of the elevator cup.

25. The refillable cosmetic dispenser of claim 22 wherein the plural resiliently deflectable members project from a locking member attached to the elongate body.

26. The refillable cosmetic dispenser of claim 21 wherein the locking formations retained by the elongate body and the elevator cup have a locked condition wherein the locking formations engage to lock the elevator cup in a retracted position relative to the elongate body.

27. The refillable cosmetic dispenser of claim 21 wherein the elevator cup has a base portion and wherein the at least one locking formation of the elevator cup projects longitudinally from the base portion.

28. The refillable cosmetic dispenser of claim 21 wherein the dispenser base further comprises a release member and wherein the release member comprises a central column fixed to the elongate member with a tip portion that is operative to actuate the locking formations from the locked condition to the unlocked condition whereby the tip portion comprises an unlocking formation.

29. A refill cartridge for a refillable cosmetic dispenser for a stick cosmetic, the refill cartridge comprising:

an elongate body with a proximal end and a distal end;

an elevator cup disposed within the elongate body for retaining the stick cosmetic wherein the elevator cup has at least one locking formation;

an extension and retraction mechanism for selectively adjusting the elevator cup between a retracted position and an extended position relative to the elongate body;

at least one locking formation retained by the elongate body;

wherein the locking formations retained by the elongate body and the elevator cup have a locked condition wherein the locking formations engage to lock the elevator cup against movement relative to the elongate body, wherein the locking formations have an unlocked condition wherein the locking formations are not engaged to lock the elevator cup against movement relative to the elongate body, and wherein the locking formations are biased to the locked condition whereby the elevator cup can be locked against movement relative to the elongate body absent actuation of the locking formations from the locked condition to the unlocked condition; and wherein the at least one locking formation retained by the elongate body comprises at least one resiliently deflectable member.

30. The refill cartridge of claim 29 wherein the at least one locking formation retained by the elongate body projects from a locking member attached to the elongate body.

31. The refill cartridge of claim 29 wherein the at least one locking formation retained by the elongate body comprises plural resiliently deflectable members.

32. The refill cartridge of claim 31 wherein the plural resiliently deflectable members comprise resiliently deflectable fingers wherein the plural resiliently deflectable fingers are disposed along a circular shape wherein a transition from the locked condition to the unlocked condition comprises deflecting the resiliently deflectable members out of engagement with the at least one locking formation of the elevator cup.

33. The refill cartridge of claim 32 wherein each of the plural resiliently deflectable fingers has an inwardly sloped proximal portion.

34. The refill cartridge of claim 32 wherein the plural resiliently deflectable members project from a locking member attached to the elongate body.

35. The refill cartridge of claim 29 wherein the locking formations retained by the elongate body and the elevator cup have a locked condition wherein the locking formations engage to lock the elevator cup in a retracted position relative to the elongate body.

36. The refill cartridge of claim 29 wherein the elevator cup has a base portion and wherein the at least one locking formation of the elevator cup projects longitudinally from the base portion.

37. The refill cartridge of claim 36 wherein the at least one locking formation of the elevator cup comprises an annular hook structure with a round base wall that projects from the base portion of the elevator cup and an outwardly projecting annular ridge retained by the base wall.

38. The refill cartridge of claim 29 wherein the extension and retraction mechanism comprises a rotary extension and retraction mechanism wherein the elongate body comprises an inner body and further comprising a spiral member concentric with the inner body wherein the inner body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby, when the locking formations are in the unlocked condition, the elevator cup can be manipulated between the retracted position and the extended position by a relative rotation of the inner body and the spiral member.

* * * * *